US005915836A

United States Patent [19]

Campbell

[11] Patent Number: 5,915,836

[45] Date of Patent: Jun. 29, 1999

[54] EARTH HANDLING APPARATUS AND METHOD

[76] Inventor: Kenneth W. Campbell, Rte. 1, P.O. Box 185, Big Cabin, Okla. 74332

[21] Appl. No.: 08/848,128

[22] Filed: Apr. 28, 1997

[51] Int. Cl.[6] ..... E02F 3/64

[52] U.S. Cl. ..... 37/435; 37/341; 172/684.5

[58] Field of Search ..... 172/684.5; 414/703; 37/307, 316, 341, 392, 411, 435, 436, 441

[56] References Cited

U.S. PATENT DOCUMENTS

| | | | |
|---|---|---|---|
| 1,868,122 | 7/1932 | Tharp | 37/435 |
| 1,868,123 | 7/1932 | Tharp | 37/435 |
| 1,965,364 | 7/1934 | Bird | 37/441 |
| 2,024,483 | 12/1935 | Slaker et al. | 37/37 |
| 2,063,698 | 12/1936 | Roe | 37/411 |
| 2,398,991 | 4/1946 | Arps . | |
| 2,528,741 | 11/1950 | Clark | 37/435 |
| 2,556,284 | 6/1951 | Maloon | 37/435 |
| 2,606,376 | 8/1952 | Mork | 37/441 X |
| 2,607,137 | 8/1952 | Kunneman | 37/441 X |
| 2,691,835 | 10/1954 | Mason | 37/435 |
| 2,923,074 | 2/1960 | Tucker | 37/441 |
| 3,474,550 | 10/1969 | Frank | 37/435 |
| 3,561,538 | 2/1971 | Curlett et al. | 172/4.5 |
| 3,591,935 | 7/1971 | Bremmer et al. . | |
| 3,670,822 | 6/1972 | Reinhardt | 172/7 |
| 3,941,262 | 3/1976 | Moser et al. . | |
| 4,454,665 | 6/1984 | Mannbro . | |
| 4,552,226 | 11/1985 | Platter . | |
| 5,407,014 | 4/1995 | Tranmer . | |
| 5,412,884 | 5/1995 | Staples et al. | 37/342 |

*Primary Examiner*—Victor Batson

*Attorney, Agent, or Firm*—Fellers, Snider, Blankenship, Bailey & Tippens

[57] ABSTRACT

An earth handling apparatus and a method for cleaning livestock ponds. The inventive apparatus comprises: a body structure; a hitch positioned at the forward end of the body structure for coupling the apparatus with a tractor, maintainer, or other appropriate vehicle; a plurality of wheels rotatable mounted for carrying the body structure; a scoop structure operably mounted behind the rearward end of the body structure; and at least one positioning assembly for raising, lowering, and rotating the scoop structure. The inventive method comprises the steps of: moving the inventive apparatus into a pond; operating the positioning assembly to lower the scoop structure such that the scoop structure contacts the bottom of the pond; pulling the inventive apparatus such that material on the bottom of the pond is scooped into the scoop structure; operating the positioning assembly to raise the scoop structure and rotate the scoop structure as necessary to retain the scooped material in the scoop structure; and removing the material from the pond by pulling the inventive apparatus out of the pond.

11 Claims, 2 Drawing Sheets

EARTH HANDLING APPARATUS AND METHOD

FIELD OF THE INVENTION

The present invention relates to earth handling apparatuses and methods. More particularly, but not by way of limitation, the present invention relates to apparatuses and methods for cleaning earthen livestock ponds.

BACKGROUND OF THE INVENTION

To maintain full capacity and ensure effective operation, earthen livestock ponds periodically must be cleaned. Livestock ponds are typically filled by natural springs and/or by melted snow or rainwater flowing over land and/or through creeks. Such water carries silt, dirt, and other materials which collect on the bottoms of the ponds.

A need presently exists for an efficient, reliable, and cost effective apparatus and method for cleaning earthen livestock ponds. Heretofore, livestock ponds have typically been cleaned using maintainers or using tractors equipped with front end shovels. Unfortunately, such devices tend to slide or bog down in the in wet, silty, materials deposited in livestock ponds. These devices are therefore inefficient and/or very difficult to operate.

Cranes of the type used for digging at construction sites typically are not readily available for pond cleaning. Moreover, the cost of moving and operating such equipment is typically too high for pond cleaning operations.

SUMMARY OF THE INVENTION

The present invention satisfies the needs and resolves the problems discussed above. The invention provides an efficient, reliable, and cost-effective apparatus and method for cleaning livestock ponds. Further, the inventive apparatus is well suited for digging new ponds, removing or harvesting sod, and other earth-handling/moving operations.

The inventive earth-handling apparatus comprises: a body structure; coupling means for coupling the body structure to a vehicle such that the apparatus can be moved using the vehicle; carrying means for carrying the body structure when moving the apparatus using the vehicle; and collecting means, operably extending from the body structure, for collecting earth.

The inventive apparatus preferably comprises: a body structure having a first end and a second end; a coupling means, positioned at the first end of the body structure, for temporarily coupling the body structure to a vehicle such that the apparatus can be moved using the vehicle; a plurality of wheels rotatably mounted for carrying the body structure when moving the apparatus using the vehicle; a scoop structure operably mounted behind the second end of the body structure; first positioning means pivotably connected to the scoop structure at a first site; and second positioning means pivotably connected to the scoop structure at a second site. The first positioning means is operable for selectively positioning the first site of the scoop structure with respect to the body structure. The second positioning means is operable for selectively positioning the second site of the scoop structure with respect to the body structure. The first positioning means is separate from the second positioning means.

The inventive method for cleaning an earthen livestock pond preferably comprises the steps of: (a) moving the inventive cleaning apparatus into the pond using a vehicle coupled thereto; (b) operating the scoop structure positioning means to lower the scoop structure such that the scoop structure contacts the bottom of the pond; (c) pulling the inventive apparatus using the vehicle such that material on the bottom of the pond is scooped into the scoop structure; (d) operating the scoop structure positioning means to raise the scoop structure such that the scooped material is retained in the scoop structure; and (e) removing the scooped material from the pond by pulling the inventive apparatus out of the pond using the vehicle.

Further objects, features, and advantages of the present invention will be apparent upon examining the accompanying drawings and upon reading the following description of the preferred embodiments.

DESCRIPTION OF THE PREFERRED EMBODIMENTS

Figure 1:
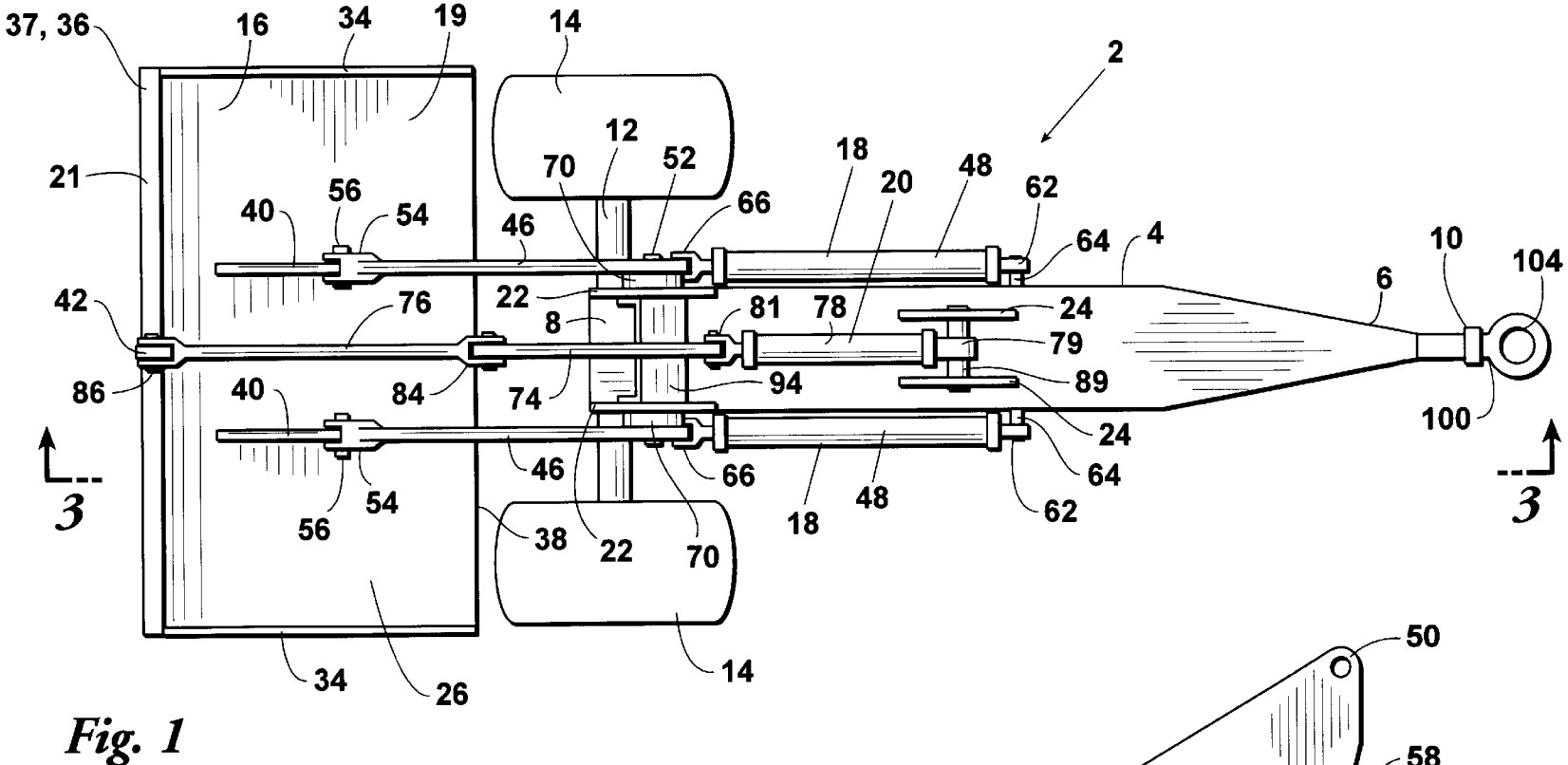
FIG. 1 depicts a plan view of an embodiment 2 of the apparatus provided by the present invention.
Figure 2:
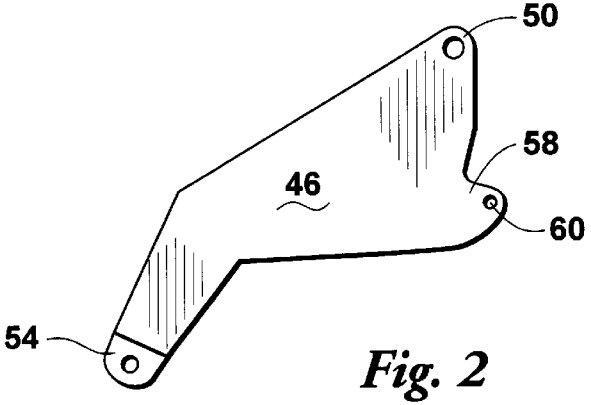
FIG. 2 provides an elevational side view of an operating plate 46 used in inventive apparatus 2.
Figure 5:
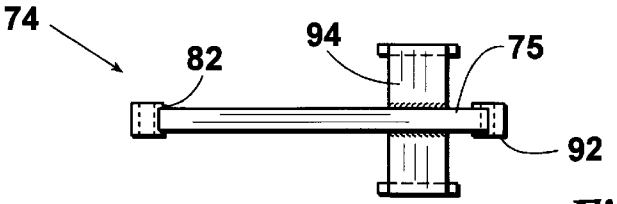
FIG. 5 provides a plan view of boom 74.
Figure 4:
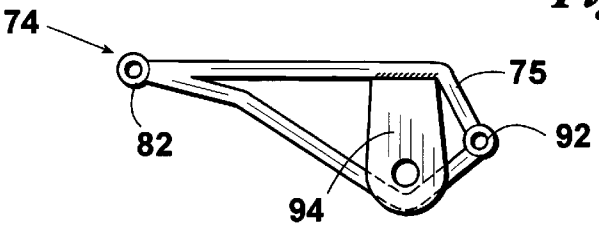
FIG. 4 provides an elevational side view of a boom 74 used in inventive apparatus 2.

An embodiment 2 of the earth-handling apparatus provided by the present invention is depicted in FIGS. 1–5. Inventive apparatus 2 comprises: a body 4 having a forward end 6 and a rearward end 8; a hitch 10 provided at forward end 6 of body 4; an axle 12 mounted at rearward end 8 of body 4; a pair of wheels 14 rotatably mounted on axle 12; a scoop structure 16 operably positioned behind rearward end 8 of body 4; a first positioning assembly 18 for selectively positioning the bottom 19 of scoop structure 16 with respect to the rearward end 8 of body 4; and a second positioning assembly 20 for selectively positioning the top portion 21 of scoop structure 16 with respect to rearward end 8.

Figure 3:
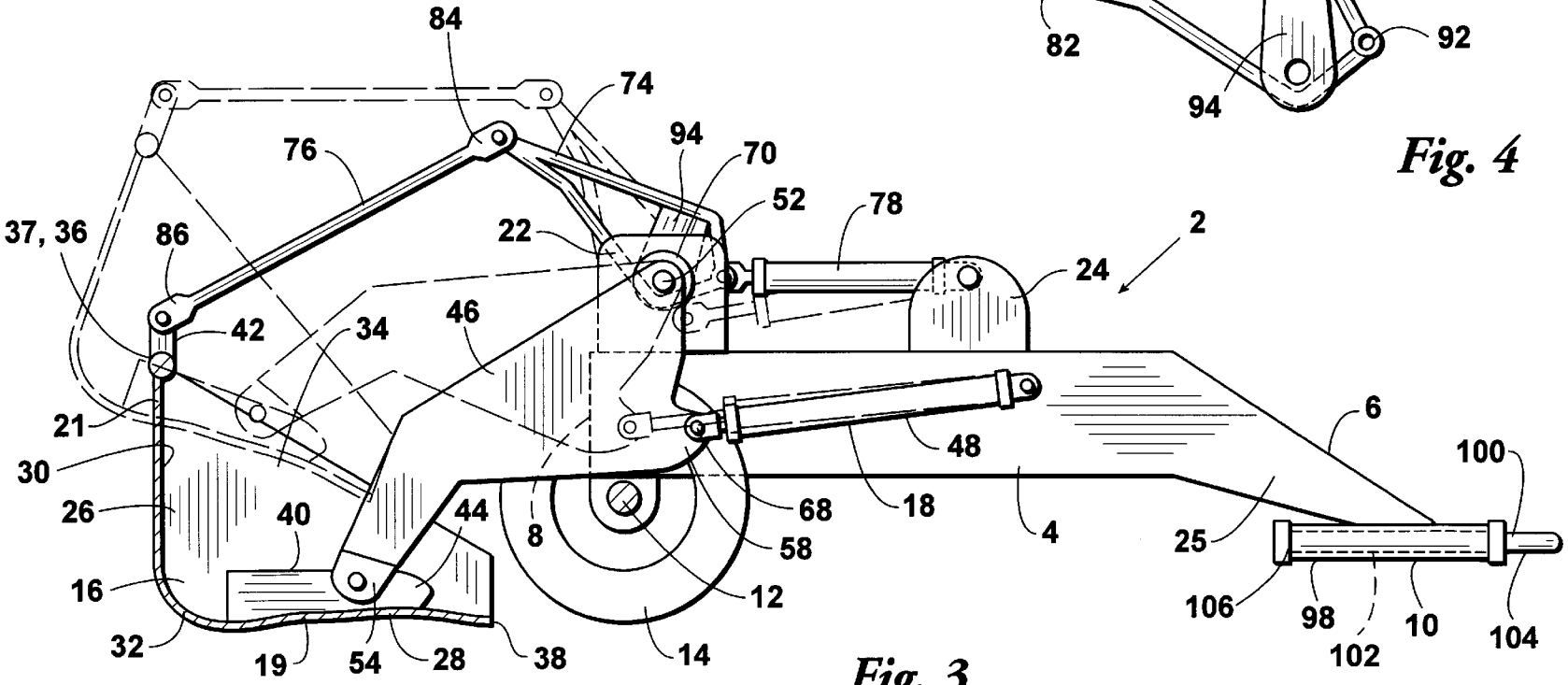
FIG. 3 provides a partially cutaway side view of inventive apparatus 2 as seen from perspective 3—3 shown in FIG. 1.

Body 4 is preferably an elongate, tongue-type structure of the type depicted in FIGS. 1 and 3. Body 4 includes a first pair of parallel pivot plates 22 projecting upwardly from rearward end 8 and a second pair of parallel pivot plates 24 projecting upwardly from the mid-portion of body 4. Body 4 also preferably includes a downwardly tapered, gooseneck-type forward extension 25 to which hitch 10 is attached. In operation, gooseneck extension 25 serves to position axle 12 at an elevation higher than that of hitch 10. Gooseneck extension 25 thereby facilitates the use of larger diameter wheels 14.

Scoop structure 16 preferably includes a scoop 26 having (a) a slightly convex bottom wall 28, (b) a substantially straight back wall 30, (c) a radiused wall 32 providing a curved transition from bottom wall 28 to back wall 30 and (d) a pair of substantially vertical end walls 34 covering the ends of scoop 26. A substantially horizontal support bar 37 is preferably secured across the top edge 36 of back wall 30. Bottom wall 28 includes a forward edge 38 which runs substantially perpendicular to body 4 and serves as a cutting and scooping edge when operating inventive apparatus 2.

Scoop structure 16 preferably further comprises (a) a pair of vertical, parallel attachment plates 40 positioned inside scoop 26 and (b) an attachment bar 42 extending upwardly from upper support bar 37. Attachment plates 40 are preferably secured to bottom wall 28. To further facilitate the scooping process, attachment plates 40 preferably have tapered leading ends 44.

First positioning assembly 18 preferably includes a pair of parallel operating arms/plates 46 and a pair of operating rams 48. Each operating plate 46 preferably includes: a first end 50 pivotably mounted on body 4 by means of a pivot shaft 52 extending through upper body plates 22; a clevis-type bottom end 54 pivotably secured to a scoop attachment plate 40 by means of a pivot pin 56; and a forwardly projecting midportion 58 having an aperture 60 provided therethrough. Rams 48 include first ends 62 which are pivotably mounted on pins 64 projecting from the sides of body 4. Rams 48 also include clevis-type second ends 66 which are pivotably attached to operating arms 46 by means of pivot pins 68 extending through apertures 60. As will be apparent, rams 48 are operable for pivoting operating arms 46 about pivot shaft 52. Thus, rams 48 and operating plates 46 are operable for selectively positioning scoop bottom wall 28 (including forward edge 38) with respect to the rearward end 8 of body 4.

First positioning assembly 18 also includes a pair of washer plates 70 positioned between operating arms 46 and body plates 22. Washer plates 70 shield body plates 22 from frictional wear and provide sufficient spacing between operating arms 46 and body 4 to allow attachment of rams 48 to arms 46.

Second positioning assembly 20 preferably comprises: a boom-type structure 74 having a base portion 75 pivotably mounted between body plates 22; a rigid connecting rod 76 having a clevis-type first end 84 pivotably attached to the distal end 82 of boom 74 and a clevis-type second end 86 pivotably attached to scoop attachment bar 42; and a ram 78 having a first end 79 pivotably mounted between upper body plates 24 by means of a pivot pin 89. Ram 78 also has a clevis-type second end 81 pivotably connected to an attachment structure 92 forming a part of, and extending forwardly from the base of, boom 74. Boom 74 preferably includes a lateral, U-shaped mounting brace 94 having pivot shaft 52 extending therethrough.

Second positioning assembly 20 is operable for selectively pivoting top edge 36 of scoop 26 about plate attachment pins 56 in order to selectively position top edge 36 with respect to the back end 8 of body 4. When ram 78 is extended, distal end 82 of boom 74 pivots upward about pivot shaft 52. As boom 74 pivots upward, connecting rod 76 pulls scoop attachment bar 42 such that top edge 36 of scoop 26 pivots upward. When ram 78 is retracted, the top edge 36 of scoop 26 is caused to pivot downward about plate attachment pins 56.

Rams 48 and 78 are preferably hydraulic rams which can be readily linked, by well-known means, to a common hydraulic system provided by the tractor, maintainer, or other vehicle used for operating inventive apparatus 2. However, as will be understood by those skilled in the art, rams 48 and 78 can alternatively be replaced with screw-type operators or generally any type of hydraulic, electric, or other known operating mechanisms.

Hitch 10 is preferably an army-type hitch comprising (a) a horizontally extending hitch cylinder 98 rigidly secured to forward end 6 of body 4 and (b) a coupling member 100 rotatably secured in cylinder 98. Coupling member 100 includes: an elongate rod 102 rotatably extending through cylinder 98; a coupling loop 104 provided at the forward end of rod 102; and a retaining cap 106 secured to the rearward end of rod 102. Retaining cap 106 retains rod 102 within cylinder 98. Hitch 10 is provided for temporarily/removably coupling inventive apparatus 2 to a tractor, maintainer, or generally any other type of vehicle capable of moving and operating inventive apparatus 2. Due to the rotational freedom provided by hitch 10, hitch 10 protects the vehicle from damage should apparatus 2 become tilted to an excessive degree.

Wheels 14 are operable for carrying body 4 when pulling inventive apparatus 2. Although a pair of wheels 14 are preferred, generally any number of wheels can be used for carrying body 4. Additionally, although wheels 14 are preferably mounted on body 4 in the manner depicted in FIGS. 1 and 3, wheels 14 could alternatively be mounted on operating plates 46. Further, as will be understood by those skilled in the art, rather than passively mounting wheels 14 in the manner depicted in FIGS. 1 and 3, motors (preferably hydraulic motors) and associated gear mechanisms (not shown) can optionally be installed for imparting a desired amount of driving power to wheels 14.

As mentioned above, the vehicle coupled to inventive apparatus 2 will preferably include a standard hydraulic system which can be used for operating the various hydraulic mechanisms employed in inventive apparatus 2. However, if desired, a separate hydraulic pump system could alternatively be used for operating the hydraulic mechanisms. As will be understood by those skilled in the art, a separate hydraulic pump could advantageously be powered by a common power take off (PTO) system provided by the operating vehicle.

When using inventive apparatus 2 for cleaning a livestock pond, the pond will preferably first be drained. Apparatus 2 is then backed into the pond using an appropriate vehicle. Due to the positioning of scoop 26 behind body 4, scoop 26 can be operably positioned in the pond without placing the wheels of the operating vehicle in the silty material deposited in the pond. As the silty material is removed from the outer portions of the livestock pond, the vehicle can be safely used to back inventive apparatus 2 further into the pond.

With inventive apparatus 2 positioned in the livestock pond, first and second positioning assemblies 18 and 20 are operated together, as needed, to lower scoop 26. Scoop 26 is preferably lowered in a manner such that forward edge 38 contacts the bottom of the pond and is angled at least slightly downward. Apparatus 2 is then pulled forward such that leading edge 38 scrapes the bottom of the pond and thereby scoops material into scoop 26. Next, first and second positioning assemblies 18 and 20 are preferably operated to raise scoop 26 and pivot forward edge 38 upward to thereby ensure that the collected material is retained in scoop 26 for transport. Apparatus 2 is then pulled by the vehicle to a desired material delivery site. At the delivery site, positioning assemblies 18 and 20 are operated as necessary to rotate scoop 26 and thereby dump the material contained therein. Apparatus 2 is then pulled back to the pond and the process is repeated until the pond is sufficiently cleaned.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed:

1. An apparatus for handling earth comprising:

a body having a forward end portion and a rearward end;

a coupling structure, provided at said forward end portion, for removably coupling said body to a vehicle such that said apparatus can be moved using said vehicle;

a scoop, operably mounted rearwardly of said rearward end, said scoop having a lower, forward scooping edge;

a plurality of wheels, all of which being rotatably mounted forwardly of said scoop, for carrying said apparatus when moving said apparatus using said vehicle; and scoop positioning means for (i) raising and lowering said scoop, (ii) extending said lower scooping edge rearwardly away from said rearward end and from said wheels, and (iii) moving said lower scooping edge forwardly toward said rearward end and said wheels, wherein said scoop has a rearward, upwardly extending back portion and wherein said scoop positioning means comprises:

a boom pivotably supported by said body for pivoting about a pivot axis;

a rigid member having a first end portion pivotably connected to said boom and a second end portion pivotably linked to said upwardly extending back portion of said scoop; and operating means for pivoting said boom about said pivot axis.

2. The apparatus of claim 1 wherein said body is an elongate structure and wherein said body has a downwardly sloping, gooseneck-type forward portion.

3. The apparatus of claim 2 wherein said coupling structure is provided at a lowermost end of said gooseneck-type forward portion.

4. The apparatus of claim 3 having a rearward most pair of said wheels, wherein:

said rearward most pair of wheels have an axis of rotation located at a first elevation, said coupling structure is located at a said second elevation, and said first elevation is higher than said second elevation.

5. The apparatus of claim 1 further comprising a unitary axle laterally secured to a rearward portion of said body and having a first end and a second end and wherein one of said wheels is rotatably mounted on said first end and a second one of said wheels is rotatably mounted on said second end.

6. The apparatus of claim 1 wherein said scoop positioning means comprises:

a first rigid positioning arm pivotably supported by said body for pivoting about a first pivot axis and having an end pivotably connected to said scoop at a first location inside said scoop;

a second rigid positioning arm pivotably supported by said body for pivoting about a second pivot axis and having an end pivotably connected to said scoop at a second location inside said scoop;

first operating means for pivoting said first rigid positioning arm about said first pivot axis; and second operating means for pivoting said second rigid positioning arm about said second pivot axis.

7. The apparatus of claim 6 wherein:

said first operating means is a first hydraulic ram having a first end pivotably secured to said first rigid positioning arm and a second end pivotably supported by said body and said second operating means is a second hydraulic ram having a first end pivotably secured to said second rigid positioning arm and a second end pivotably supported by said body.

8. The apparatus of claim 1 wherein said operating means is a hydraulic ram having a first end pivotably secured to said boom and a second end pivotably supported by said body.

9. The apparatus of claim 1 wherein said lower forward scooping edge is a substantially straight, lateral edge.

10. An apparatus for handling earth comprising:

a body having a forward end portion and a rearward end;

a coupling structure, provided at said forward end portion, for removably coupling said body to a vehicle such that said apparatus can be moved using said vehicle;

a scoop, operably mounted rearwardly of said rearward end, said scoop having a lower, forward scooping edge;

a plurality of wheels, all of which being rotatably mounted forwardly of said scoop, for carrying said apparatus when moving said apparatus using said vehicle; and scoop positioning means for (i) raising and lowering said scoop, (ii) extending said lower scooping edge rearwardly away from said rearward end and from said wheels, and (iii) moving said lower scooping edge forwardly toward said rearward end and said wheels, wherein said scoop positioning means comprises:

a first rigid positioning arm pivotably supported by said body for pivoting about a first pivot axis and having an end pivotably connected to said scoop at a first location inside said scoop;

a second rigid positioning arm pivotably supported by said body for pivoting about a second pivot axis and having an end pivotably connected to said scoop at a second location inside said scoop;

first operating means for pivoting said first rigid positioning arm about said first pivot axis; and second operating means for pivoting said second rigid positioning arm about said second pivot axis.

11. The apparatus of claim 10 wherein:

said first operating means is a first hydraulic ram having a first end pivotably secured to said first rigid positioning arm and a second end pivotably supported by said body and said second operating means is a second hydraulic ram having a first end pivotably secured to said second rigid positioning arm and a second end pivotably supported by said body.

* * * * *